United States Patent [19]

Pryor

[11] Patent Number: 4,984,641

[45] Date of Patent: Jan. 15, 1991

[54] SWIVELS

[76] Inventor: Dale H. Pryor, 1311 W. 7th St., Plainview, Tex. 79072

[21] Appl. No.: 476,073

[22] Filed: Feb. 7, 1990

[51] Int. Cl.[5] ..... E21B 3/02

[52] U.S. Cl. ..... 175/170; 173/163; 285/98

[58] Field of Search ..... 175/170, 195, 203, 57, 175/85; 173/163; 285/98, 281

[56] References Cited

U.S. PATENT DOCUMENTS 4,574,893 3/1986 Young et al. ..... 175/170

4,890,681 1/1990 Skelly ..... 173/163

*Primary Examiner*—William P. Neuder

*Attorney, Agent, or Firm*—Marcus L. Bates

[57] ABSTRACT

A swivel apparatus of the type having a main body for supporting a rotatable member, wherein the member supports a load therefrom and is journaled to the main body by a thrust bearing assembly that transfers the load from the rotatable member into the main body. The speed of rotation of the thrust bearing assembly is reduced to a value which is less than the speed of rotation of the rotatable member. This is achieved by rotatably driving a gear means by the rotatable member; and, arranging a first and a second thrust bearing and a middle race member adjacent to one another with the middle race member separating the first and second thrust bearings from one another. This enables the load carried by the rotatable member to be transferred into the first thrust bearing, into the middle race member, into the second thrust bearing, and into the main body. The middle race member is rotatably driven by the rotating gear means in a manner to cause the middle race member to rotate in opposition to the rotatable member at a speed which is less than the speed of the rotatable member and thereby reduce the centrifugal force imposed on the rollers of the thrust bearings by reducing the speed of rotation thereof. This invention further includes rotatably supporting a washpipe from the swivel main body and connecting the washpipe to the rotatable member with seal means so that fluid can flow through the washpipe, into said rotatable member; and, rotatably driving the washpipe in the same direction and at reduced rotational speed respective to the rotatable member in response to rotation of said rotatable member.

19 Claims, 3 Drawing Sheets

TO FIG. 4

SWIVELS

BACKGROUND OF THE INVENTION

This invention relates to a swivel and particularly a swivel used in water and oil well drilling. The main purpose of a swivel is the support for the enormous weight of a drill pipe as it is being turned, which requires the swivel to have bearings of sufficient capacity to support the pipe load. An equally important purpose of the swivel is to convey the drilling fluid from a stationary supply to the rotating pipe. Swivels are presently in use to accomplish these purposes; however, normal drilling is carried out at relatively low rotational speeds, and when the speed exceeds 300–400 rpm, several problems are encountered. The first problem is the maximum bearing speed is exceeded, and the second is the washpipe seal velocity is exceeded. This invention addresses both of these problems.

Thrust bearing speed of a swivel primarily is limited by the sliding friction of the rollers against the shoulder of the race, which is required to resist the effect of centrifugal force produced by the rollers themselves. As the rotational speed increases, the centrifugal force increases, and the frictional force increases, thereby producing ever increasing heat. The present invention overcomes this problem by the unique arrangement of two thrust bearings rather than one as is customary in the prior art. The sleeve which interconnects the swivel to the drill pipe has a drive gear formed thereon.

A support flange carries the load from the sleeve down to the upper bearing. This bearing in turn transmits the load through its races and roller assembly, through a middle race gear, to the lower bearing assembly, and finally into the swivel housing.

Before continuing, consider first a prior art swivel having only one bearing, with a sleeve speed of 1200 rpm. The rollers will have a velocity of one-half that, or 600 rpm, relative to the axis of the sleeve. The roller speed about their own axis is much higher, but the rpm that affects the centrifugal force against the shoulder radius is the one relative to the axis of the sleeve.

Consider what would happen if the stationary race of the above prior art bearing could be turned at the same speed but in opposite direction of the race powered by the sleeve. The rollers would turn relative to their own axis but would remain stationary relative to the axis of the sleeve or the bearing assembly. On the other hand, if it were turned at half speed and in the opposite direction, it would have the effect of changing the roller rpm relative to the axis of the bearing from 600 rpm to 300 rpm, and the centrifugal effect would be equivalent to that of a bearing assembly running at half speed. In this example, the fatigue life of the bearing would be reduced because the relative velocity and the number of load cycles has increased from 1200 rpm to 1800 rpm, therefore the bearing size must be increased to compensate for this change.

In the present invention, the second thrust bearing is required to allow for the rotation of both races in the top bearing. Its speed would be the same as the lower race of the upper bearing, which in the case above would be 600rpm, but the life would be much greater as its life is based also on 600 rpm. If desired, this lower bearing could be a smaller capacity bearing and still be an equivalent bearing.

In this invention, a novel drive arrangement is shown to provide the turning of the inner races which would be designed to run the inner races in the opposite direction of the sleeve and at half speed, for example.

The washpipe seal problem is based upon flow requirements and peripheral velocity of the washpipe surface riding against the washpipe seal. Since the pressure of the drilling mud to the improved swivel will be approximately the same as the prior art, the velocity of the rotating washpipe against the stationary seal must be changed. One way to accomplish this is to reduce the diameter of the washpipe. However, in most cases, this would not be possible as the pressure drop through this diameter determines the amount of fluid that can be pumped to the bit. In the prior art configuration, one end of the washpipe is held stationary and the packing attached to the sleeve rotates on the other. In this invention, packing is placed on both ends of the washpipe, and the washpipe is rotated at half the speed, but in the same direction as the sleeve, thus reducing the effective peripheral sleeve velocity to one half that of the prior art washpipe arrangement.

Accordingly, the present invention provides method and apparatus by which a prior art drill string can be rotated at about twice the rotational speed presently allowed by a swivel.

SUMMARY OF THE INVENTION

A swivel has a main body within which a rotating member is mounted for supporting a load. The rotating member is journaled to the main body by concentric thrust bearings separated by a middle race member. A gear drive is interposed between the rotating member and the middle race member for rotating the middle race member at a reduced speed and in a direction opposite to the rotation of the rotating member. This novel arrangement reduces the wear on the thrust bearings and thereby permits the rpm of the rotating member to be increased.

In one form of the invention, a shaft is driven by a driver gear attached to the rotating member. The driver gear has a lower annular face which bears against the upper thrust bearing and transfers loads from the rotating member, into the thrust bearings, and into the main body. The shaft is connected to drive the middle race member.

In another form of the invention, a ring gear is arranged in a concentric manner about the rotating member and includes a gear formed on the inner peripheral wall surface thereof which is driven by the rotating member. The middle race member is an inwardly directed flange connected to the ring gear for driving the middle race member in opposition to the direction of rotation of the rotating member.

In either of the above forms of this invention, the rotating member can be made into a hollow sleeve which is adapted to support a drill string used in borehole forming operations. A washpipe is rotatably mounted to the main body and flow connected at one end to the sleeve and flow connected at the other end to a stationary conduit. Drilling fluid flows through the stationary conduit, through the washpipe, through the sleeve, and to the drill string. The washpipe is connected to be driven by the sleeve at reduced rpm and in the same direction of rotation of the sleeve. This reduces the wear between the seals and the rotating washpipe.

A primary object of this invention is the provision of a swivel having a rotating load supporting member received within a pair of superimposed thrust bearings, with the adjacent races of the bearings being arranged to be rotated in opposition to the rotating member and at an rpm that reduces the centrifugal force on the rotating thrust bearings.

Another object of the present invention is the provision of a swivel having a washpipe journaled thereto and rotated at reduced speed to thereby reduce the wear thereon.

A still further object of this invention is the provision of a rotating member arranged in journaled relationship within a main body by a pair of adjacent axially aligned thrust bearings having confronting races driven in opposition respective to the rotating member.

Another and still further object of the present invention is to achieve higher rpm of a rotating member by the provision of a pair of superimposed thrust bearings arranged to be rotated at reduced rpms about the rotating member.

A further object of this invention is to reduce the wear on the thrust bearings and the washpipe of a swivel.

An additional object of this invention is to achieve higher rpms in a swivel means.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described herein.

DETAILED DESCRIPTION OF THE PREFERRED EMBODIMENT

Figure 1:
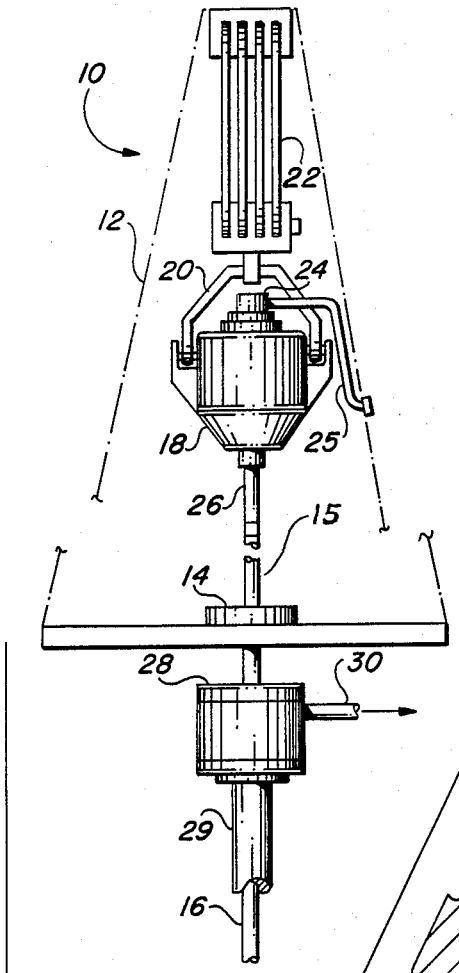
FIG. 1 is a diagrammatical representation of a drilling rig that includes the present invention associated therewith.

In the diagrammatical representation of FIG. 1, there is disclosed a drilling rig 10 that includes a derrick 12 and the usual turntable 14. The turntable rotates a kelly 15 located at the upper end of a drill string 16. The upper end of the kelly is connected to a swivel 18 made in accordance with this invention. The swivel 18 has the usual bail 20 from which the swivel is suspended from the hook of a traveling block 22. A washpipe 24 terminates in a gooseneck which connects a flexible mud supply hose 25 to the swivel 18. The kelly is connected to the lower terminal end of a sleeve 26 of the swivel 18.

A rotating stripper assembly 28 is connected to the upper end of casing 29 and includes the usual out flow pipe 30 by which mud that is returned uphole is directed to a mud pit (not shown). Accordingly, drilling fluid is supplied from non-rotating conduit 25 to the swivel 18 so that the mud flows into the rotating sleeve, kelly, rotating drill string, downhole to a bit, back uphole to the rotating blowout preventor where it exits the fixed side outlet 30, and is returned to the mud pit. Accordingly, the swivel 18 must be able to rotatably support hundreds of thousands of pounds of rotating drill string 16 and at the same time transfer drilling fluid from a fixed source 25 into the rotating drill string 16.

Figure 2:
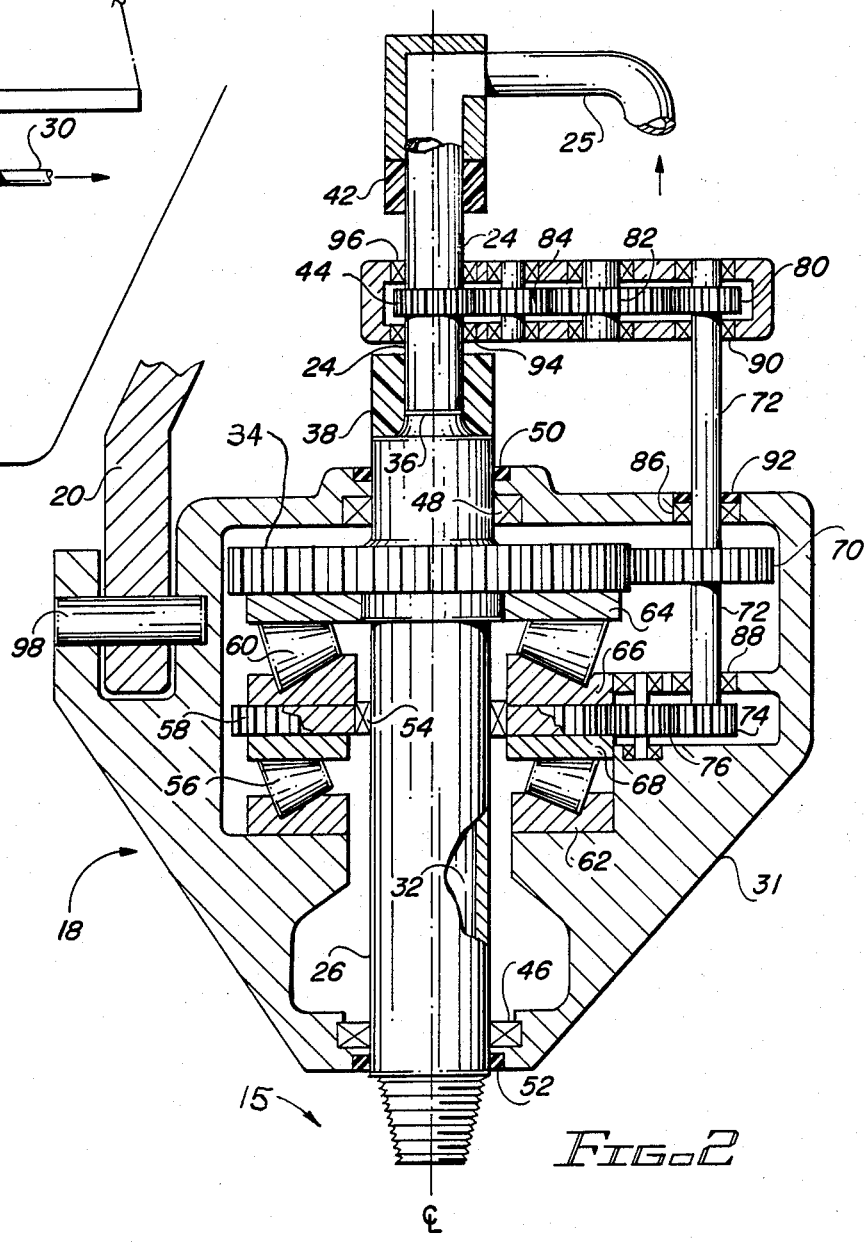
FIG. 2 is a part diagrammatical, part schematical, longitudinal, part cross-sectional view of a swivel made in accordance with the present invention with the sections being arranged 90° for clarity.

FIG. 2 schematically discloses in a diagrammatical manner one form of the present invention. In FIG. 2, the sections about the longitudinal axial centerline are taken 90° apart, and therefore the bail 20 is shown only on the left side of the drawing figure. The sleeve 26 is axially aligned with the washpipe 24 and terminates in the illustrated threaded male connection at the lower end thereof. A driver gear 34 is rigidly attached to and rotates with sleeve 26. The upper end of the sleeve terminates adjacent the lower end 36 of the washpipe 24 at seal means 38, which confines flow of fluid to the interior of the washpipe and sleeve. The opposed marginal end of the washpipe is rotatably received within seal means 42, so that fluid is confined to the interior of the stationary member 25. Gear 44 is attached to and rotates the washpipe 24 within its seals 38, 42.

A lower and upper centralizing bearing 46 and 48, respectively, are located at the lower and upper marginal ends of the sleeve 26, respectively. Upper and lower seals 50 and 52 are located outwardly of the upper and lower bearings 48 and 46. A centrally located bearing 54 is located at a medial part of the sleeve 26. A lower thrust bearing 56 is supported from the swivel housing 31 and supports a middle race gear 58 which is journaled respective to sleeve 26 by means of central bearing 54. Upper thrust bearing 60 bears against the middle race gear 58 and rotatably supports the driver gear 34. The swivel 18 of FIG. 2 supports the drill string of FIG. 1 as follows: the drill string is supported from the lower end of sleeve 26 of FIG. 2 and this tremendous weight is imparted into the driver gear 34, into the bearing assembly 60, into the middle race gear 58, into the lower thrust bearing 56, into the housing 31, into the bail 20, into the traveling block, and then into the drilling rig.

The lower thrust bearing assembly 56 of FIG. 2 include a lower race 62 which is removably affixed within the housing. An upper race 64 bears against the rollers of the upper thrust bearing 60 and rotates with the driver gear 34. The middle race gear 58 is attached to adjacent rotatable bearing races 66 and 68 which are located on opposed sides of the gear 58. The opposed races 66, 68 cooperate with the rollers of the upper and lower thrust bearings in the illustrated manner of FIG. 2.

The driver gear 34 is meshed with driven gear 70 which is attached to and rotates vertical shaft 72. A middle race pinion 74 is connected to the lower end of shaft 72 and is meshed with idler gear 76. The idler gear is meshed with the middle race gear 58 and rotation of shaft 72 therefore imparts rotation into the middle race gear, along with the upper and lower bearing faces 66, 68 thereof.

A washpipe drive assembly is contained within housing 78. The drive assembly includes gear 80 connected to the end of shaft 72, idler gears 82 and 84, and washpipe gear 44. Bearings 86, 88 rotatably support shaft 72 from the swivel housing 31. Seals and bearings 90, 92, 94, and 96 are suitably positioned in a well known manner.

In operation of the embodiment of FIG. 2, the drawworks (FIG. 1) rotate a turntable 14 clockwise which in turn rotates the kelly 15. The kelly 15 is supported by the swivel 18, and the swivel is supported by the traveling block 22. Therefore, the entire massive drill string is rotatably supported from bail 20 of swivel 18.

The kelly is rotated by the turntable and imparts clockwise rotation into the sleeve 26. This action rotates driver gear 34, which is meshed with driven gear 70, and causes shaft 72 to rotate counterclockwise at a speed proportional to the diameters of gears 34 and 70. This drives the middle race gear 58 counterclockwise at a speed which is proportional to the gear ratio of gears 58 and 74. At the same time, the washpipe 24 is rotated clockwise at a speed dependent upon the ratio of gears 44 and 80.

EXAMPLE

In the preferred form of the invetion, should the turntable rotate the drill string at 600 rpm, the sleeve 26 will also rotate at 600 rpm, causing shaft 72 to rotate at 1500 rpm, which in turn causes the middle race gear 58 to rotate counterclockwise 300 rpm while the washpipe 24 is rotated clockwise 300 rpm.

Accordingly, the present invention simultaneously drives the adjacent opposed races 66, 68 at half the speed of the sleeve 26 and opposite to the direction of rotation of sleeve 26, while the washpipe is driven in the same direction of rotation of sleeve 26 and at one half the rpm of the sleeve. Therefore, the opposed marginal ends of washpipe 24 rotates in upper and lower packings or seals 38 and 42 at one half the rpm of the sleeve 26.

At the same time, the roller bearings 60 rotate about the sleeve 26 and respective to the bearing races 64, 66 at one half the rpm of the sleeve 26. The roller bearings of the lower thrust bearing 56 rotate respective to the races 62, 68 at one-half the rpm of sleeve 26. Bearings 86, 88, 90 located along shaft 72 are suitably supported within the housings 31 and 78.

In FIGS. 3–6, wherever it is logical or possible to do so, like or similar numerals will refer to like or similar elements Throughout the figures of the drawings, wherever it is practical or logical to do so, like numerals will be applied to similar or like elements. In FIGS. 3–6 of the drawings, and in particular FIGS. 3 and 4, the swivel main housing 31 has a passageway extending axially therethrough, within which the rotating parts of the swivel are housed in a sealed manner so that the coacting parts are suitably connected and protected from ambient. Sleeve 26 extends through the passageway and transfers the load of the drilling string into the housing by means of the rotating bearing assembly 56–58 in a manner similar to the first embodiment of the invention.

Figure 3:
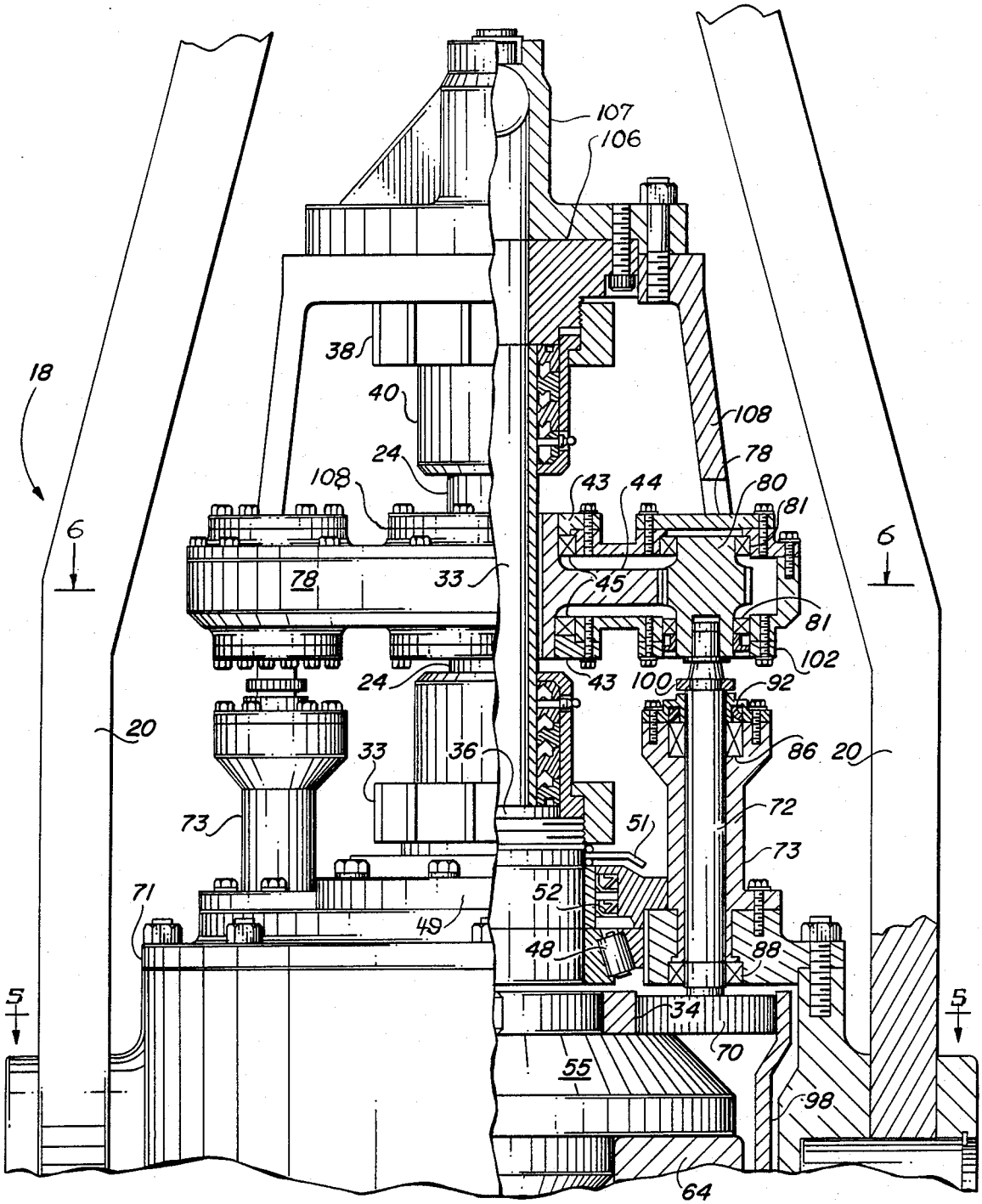
FIG. 3 is a fragmentary, longitudinal, cross-sectional, side view of the upper half of the preferred embodiment: of the present invention.
Figure 4:
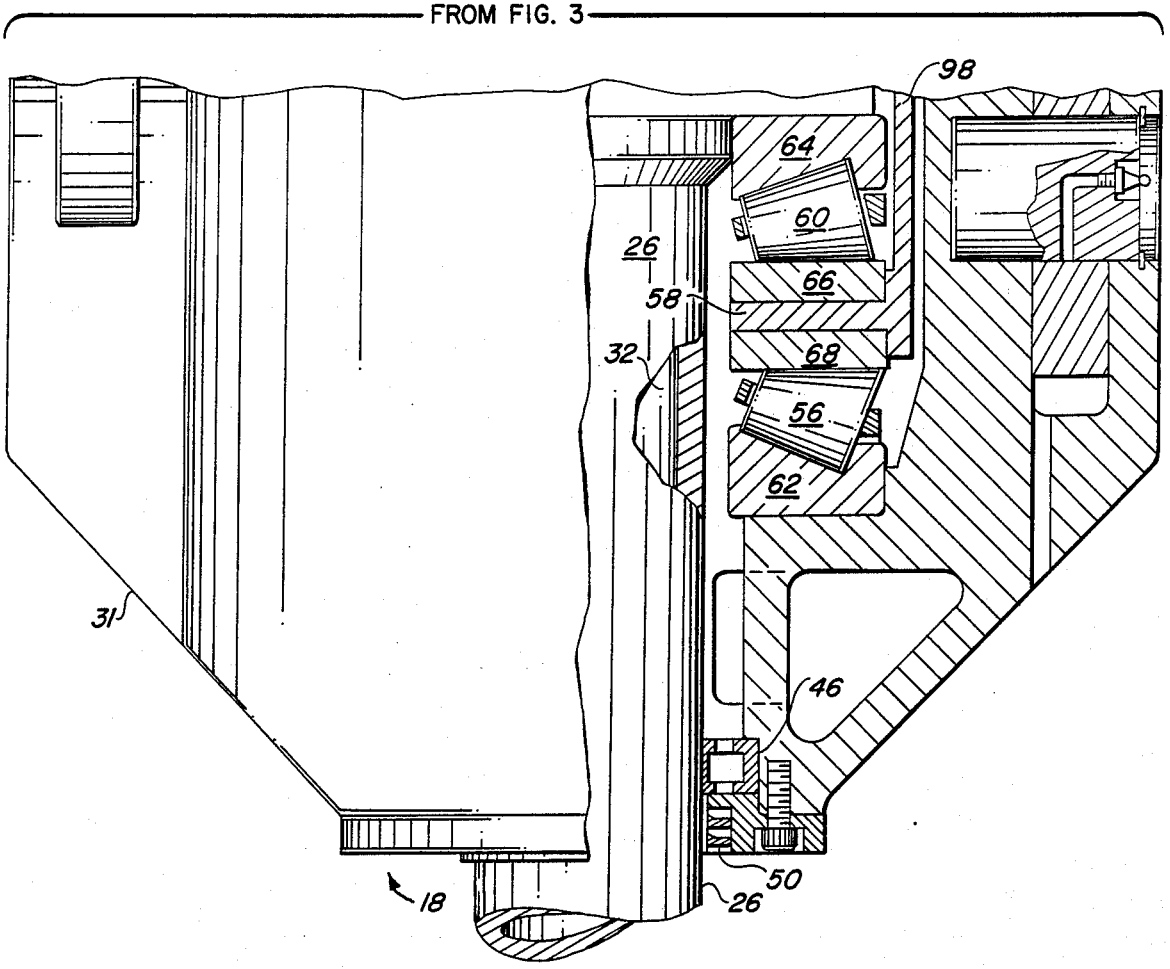
FIG. 4 is a fragmentary, longitudinal, cross-sectional, side view of the lower half of the swivel disclosed in FIG. 3.
Figure 5:
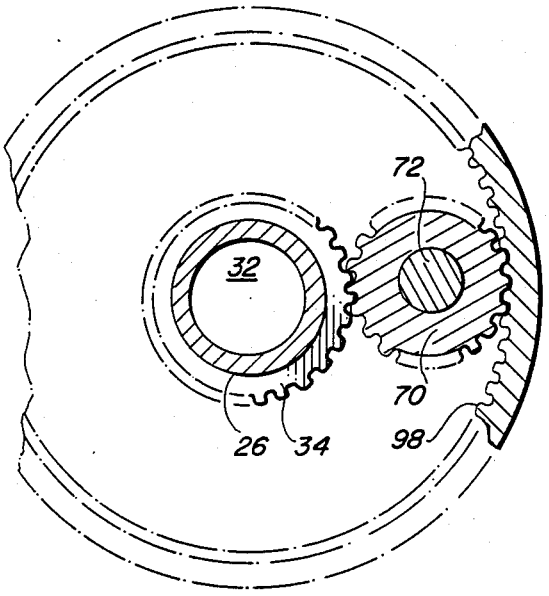
FIG. 5 is a cross-sectional view taken along line 5—5 of FIG. 3.
Figure 6:
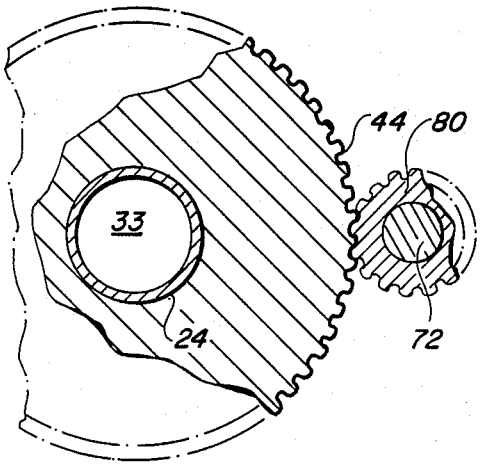
FIG. 6 is a cross-sectional view taken along line 6—6 of FIG. 3.

In FIG. 3, driver gear 34 is attached to a medial part of the sleeve 26 at a location spaced from the upper end 36 thereof. A packing assembly 33 and 38, comprised of the illustrated commercially available packing material, is arranged at opposed ends of the washpipe 24. The packing nut and packing housing 40 can take on any number of different forms so long as they sealingly receive the opposed marginal ends of the washpipe 24.

Annular bearing retainer 43 is axially aligned with washpipe drive gear 44 and provides a means by which bearings 45 along with the associated seals are retained within the illustrated housing 78. The washpipe drive gear 44 is received in mounted relationship by the bearings 45 thereby supporting the washpipe 24 and gear 44 in axial aligned relationship respective to the sleeve 26.

Lower centralizing bearing 46 is supported within the main housing and receives a lower marginal end of the sleeve 26 there through. An upper centralizing bearing 48 is indirectly supported by the main housing and receives an upper marginal end of the sleeve therethrough. Bearing retainer 49 holds the seal means 52 and retains bearing 48 in operative aligned position. Slinger ring 51 protects the seal means 52 from ingress of debris. Lower bearing retainer 50 similarly holds a seal means and retains bearing 46 in proper aligned relationship.

The sleeve 26 has an integral outwardly directed boss 55 which has been provided with a lower annular face which bears against upper race 64 and transfers the entire load of the drill string thereinto. The lower face of race 64 bears against the illustrated plurality of upper thrust bearings 60 which bear against the upper annular face of the middle race gear assembly 58. The middle race gear assembly transfers the load from the upper thrust bearing 60, into race 66, into race 68, and into the lower thrust bearing 56. The individual lower thrust bearings 56 rotatably bears against fixed race 62 which is received on the illustrated annular housing formed within the main housing 31. Hence, the entire weight of the drill string is supported by the lower race 62 of lower thrust bearing 56.

Driven gear 70 meshes with driver gear 34 and ring gear bearing drive 98. Gear 70 is attached to shaft 72 which rotates washpipe drive gear 80 which in turn rotates washpipe drive gear 44 and thereby rotates the washpipe 24 in a manner similar to the teachings of FIG. 2.

Bonnet 71 is bolted onto the upper end of the main housing 31 and receives the two drive pedestals 73 in spaced relationship thereon. Bearing retainer 49 is located radially inwardly respective to the pedestals and in axial alignment with respect to the sleeve 26. Therefore the bearing retainer 49 is axially aligned with the sleeve 26, with the pedestals 73 being located radially outwardly therefrom and the pedestals are arranged 180° apart, and both pedestals are of identical construction.

Bearings 86 and 88, located at opposed marginal ends of shaft 72, are suitably supported respective to the swivel main housing 31. The upper bearing 86 is received within the upper end of a pedestal 73, and the lower bearing 88 is received within a bonnet 71, in the illustrated manner of FIG. 3. Numeral 92 indicates a seal for bearing 86 while numeral 100 indicates a bearing lock nut.

The ring gear bearing drive 98 has gear teeth circumferentially formed about the inner peripheral wall surface at the upper end thereof that meshes with driven gear 70. The ring gear 98 has an inwardly directed flange 58' of annular configuration that terminates in spaced relationship respective to hollow sleeve 26. Opposed upper and lower faces of the flange 58 have a shoulder formed thereon for receiving opposed races 66 and 68, respectively, of thrust bearings 60 and 56, respectively. Accordingly, the flange 58 of the ring gear bearing drive, opposed with the confronting races 66 and 68, rotate as a unit and form the ring gear bearing drive.

Bearing retainer 102 provides a mount for the illustrate seal means and retains both the seal and bearing 81 in properly aligned relationship respective to the housings 31 and 78 and the gear 80. Washpipe adaptor 106 is bolted onto gooseneck fitting 107. The gooseneck fitting 107 provides a supply of drilling fluid from the illustrated inlet to the washpipe passageway 33. Superstructure 108 forms a support cage about the washpipe adaptor housing and transfers loads from the washpipe adaptor housing into the main housing 31.

It is possible for flange 58 and adjacent races 66, 68 to be made into a unitary member. It is possible for opposed races 62, 64 to be made different than suggested herein, as for example making race 62 directly onto or a part of the main housing while race 64 is made under the surface of the flange or support 55. These are not economical and logical variations because the drilling industry does not use but a limited number of swivels. 15 In operation of the preferred embodiment of FIGS. 3–6, fluid flows into the adaptor, through the rotating washpipe, and into the central passageway 32 of the rotating sleeve where the fluid is available for the kelly 15 which is attached thereto. The rotating kelly rotates the sleeve 26 and the driver gear attached thereto in a clockwise direction, thereby rotating the middle race assembly in a counterclockwise direction at one half the rotational speed of the sleeve, while the washpipe is rotated in a clockwise direction at one half the speed of the sleeve. The speed of rotation of the middle race assembly 58 and the speed of rotation of the washpipe can be selected by judicially employing gear ratios to achieve any predetermined rotational speed desired.

This novel operation of a swivel brings about the unexpected advantage of reducing the centrifugal force on the thrust bearings to an advantageously lower value and reducing the velocity of the washpipe to seal contacting surfaces to an acceptable operating speed.

I claim:

1. A swivel for supporting a rotating drill string and for conducting flow from a fixed source into the swivel and into a drill string;

said swivel has a main body, a passageway formed through said main body; a hollow, elongated sleeve mounted within said passageway for rotation about its longitudinal axis, means at the lower end of said sleeve for connection to a drill string; a driver gear affixed to said sleeve;

a shaft, a first and a second gear affixed to said shaft, means by which the first shaft gear is driven by said driver gear;

an upper and lower thrust bearing, a middle race positioned between said upper and lower thrust bearings; means by which said sleeve is supported for rotation by said upper thrust bearing, said middle race is supported by said lower thrust bearing; and, said main body supports said lower thrust bearing;

means by which said middle race is driven by said second gear in an opposite direction respective to said sleeve; whereby, the rate of rotation of the first and second thrust bearings about the sleeve is less than the rate of rotation of the sleeve, thereby reducing the centrifugal force of the first and second bearings.

2. The swivel of claim 1 wherein there is a second gear mounted to be rotated by said shaft; a washpipe, means mounting said washpipe for rotation respective to said main body, means by which said washpipe and said second gear are connected to impart rotation into said washpipe which is in the direction of rotation of said sleeve; whereby, said washpipe can be rotated at a reduced speed respective to said sleeve.

3. The swivel of claim 2 wherein said sleeve, washpipe, and gears are connected together to cause the upper and lower bearings and the washpipe to rotate at about one half the speed of the sleeve.

4. The swivel of claim 2 wherein said sleeve and washpipe are axially aligned and said middle race and washpipe driven by a common shaft.

5. The swivel of claim 1 wherein said driver gear is rigidly affixed to said sleeve, and has a lower annular face formed thereon that bears against said upper thrust bearing.

6. The swivel of claim 1 wherein said middle race is an inwardly directed flange formed on a cylindrical member, a gear formed on the inner surface of said cylindrical member that is driven by said driver gear.

7. The swivel of claim 1 wherein said sleeve, washpipe, and gears are connected together to cause the upper and lower bearings and the washpipe to rotate at about one half the speed of the sleeve;

said sleeve and washpipe are axially aligned and said middle race and washpipe driven by a common shaft;

said driver gear is rigidly affixed to said sleeve, and has a lower annular face formed thereon that bears against said upper thrust bearing.

8. The swivel of claim 1 wherein there is a second gear mounted to be rotated by said shaft; a washpipe, means mounting said washpipe for rotation respective to said main body, means by which said washpipe and said second gear are connected to impart rotation into said washpipe which is in the direction of rotation of said sleeve; whereby, said washpipe can be rotated at a reduced speed respective to said sleeve;

wherein said sleeve, washpipe, and gears are connected together to cause the upper and lower bearings and the washpipe to rotate at about one half the speed of the sleeve;

said sleeve and washpipe are axially aligned and said middle race and washpipe driven by a common shaft.

9. A swivel apparatus having a main body, an axial passageway formed therethrough, a hollow sleeve rotatably supported within said axial passageway, a hollow washpipe rotatably supported by said main body, seal means connecting said washpipe and said sleeve so that fluid can flow therethrough;

connector means by which said sleeve can be fastened to a rotating hollow member whereby fluid can flow into the washpipe, and then into the sleeve, and on to the interior of the rotating member;

first and second thrust bearings for rotatably supporting said sleeve from said main body, said first and second thrust bearings are axially aligned with said sleeve and include a middle race therebetween; drive means connected to said sleeve and said middle race by which said middle race is rotated in opposition to said sleeve and at a rotational speed which is less than the rotational speed of said sleeve;

whereby, said thrust bearings rotate about said sleeve at a rotational speed which reduces the centrifugal force on said bearings.

10. The swivel apparatus of claim 9 wherein said drive means is connected to rotate said washpipe at a rotational speed which is less than the rotational speed of said sleeve and in the same rotational direction thereof; whereby, said washpipe rotates respective to the main body at a speed which reduces the wear on said seal means.

11. The swivel of claim 9 wherein said sleeve includes an outwardly projecting annular shoulder formed thereon having a lower annular face which abbutingly engages the upper thrust bearing and transfers load from the sleeve, into the thrust bearings, and into the main body;

said drive means include a cylindrical member having said middle race formed at the lower end thereof, and a gear formed at the upper end thereof, gear means on said sleeve for engaging and rotating said cylindrical member and thereby rotating said middle race.

12. The swivel of claim 9 wherein said sleeve includes an outwardly projecting annular shoulder having a lower annular face which engages the upper thrust bearing and transfers load from the sleeve, into the thrust bearings and into the main body;

said drive means includes a cylindrical member having said middle race located at the lower end thereof and a gear located at the upper end thereof, said drive means on said sleeve includes gear means for engaging and rotating said cylindrical member and thereby rotating said middle race at a speed which reduces the centrifugal force on said thrust bearings.

13. The swivel of claim 9 wherein said sleeve, washpipe, and gears are connected together to cause the upper and lower bearings and the washpipe to rotate at about one half the speed of the sleeve;

said sleeve and washpipe are axially aligned and said middle race and washpipe driven by a common shaft.

14. In a swivel apparatus having a main body that rotatably supports a load carrying member in journaled relationship therewith;

first and second thrust bearings mounted to transfer a load from said load carrying member into said main body; a middle race member, a driver gear attached in concentric relationship to said load carrying member;

said first and second thrust bearings, said middle race member, said driver gear, and said load carrying member being axially aligned with one another with said middle race member being located between and in abutting relationship respective to adjacent sides of said first and second thrust bearings; whereby, a load placed on said load carrying member is transferred into said first thrust bearing, into said middle race member, into said second thrust bearing, and into said main body;

means connecting said driver gear for rotating said middle race member in a direction opposite to the rotation of the load carrying member, and rotating the thrust bearings at a rotational velocity which is less than the rotational velocity of the load carrying member and thereby increase the durability of the thrust bearings.

15. The swivel apparatus of claim 14 wherein said load carrying member includes an outwardly projecting annular shoulder formed thereon having a lower annular face which abbutingly engages the upper thrust bearing and transfers load from the load carrying member into the thrust bearings and into the main body;

said means connecting said driven gear includes a cylindrical member having said middle race member at the lower end thereof and a gear at the upper end thereof; gear means on said load carrying member for engaging and rotating said cylindrical member and thereby rotate said middle race member.

16. The swivel apparatus of claim 14 wherein said load carrying member is hollow; a shaft; said driver gear being connected to rotate said shaft;

a washpipe; means mounting said washpipe for rotation respective to said main body, means including seal means by which said washpipe is connected to provide flow into said load carrying member; means by which said shaft is connected to impart rotation into said washpipe; whereby, said washpipe can be rotated at a reduced speed respective to said load carrying member and thereby reduce the wear on said seal means.

17. In a swivel apparatus of the type having a main body for supporting a rotatable member, wherein the member supports a load therefrom and is journaled to the main body by a thrust bearing that transfers the load from the rotatable member into the main body, the method of reducing the speed of rotation of the thrust bearing to a value which is less than the speed of rotation of the rotatable member comprising the steps of:

rotatably driving a gear means in response to the rotating action of the rotatable member;

placing a second thrust bearing and a middle race member adjacent to the first recited thrust bearing with the middle race member separating the first and second thrust bearings from one another in a manner whereby the load carried by the rotatable member is transferred into the first thrust bearing, into the middle race member, into the second thrust bearing, and into the main body;

rotatably driving said middle race member in response to the rotating action of said gear means in a manner to cause said middle race member to rotate in opposition to said rotatable member at a speed which is less than the speed of the rotatable member;

whereby; the centrifugal force of the thrust bearings is reduced by reducing the speed of rotation thereof.

18. The method of claim 17 wherein the following additional steps are included:

rotatably supporting a washpipe from said main body; connecting said washpipe to said rotatable member with seal means so that fluid can flow through said washpipe into said rotatable member;

rotatably driving said washpipe in the same direction and at reduced rotational speed respective to said rotatable member in response to rotation of said rotatable member.

19. The method of claim 18 and further including the step of concentrically arranging an annular member about said rotatable member; forming said middle race member inwardly of said annular member; forming a gear on the interior of said annular member and driving the gear with said rotatable member.

* * * * *